US009751690B2

(12) United States Patent
Lawrence

(10) Patent No.: US 9,751,690 B2
(45) Date of Patent: Sep. 5, 2017

(54) LINER DISCHARGE STRUCTURE FOR ATTACHMENT TO CONTAINER LINER

(71) Applicant: Freedom Manufacturing LLC, Saratoga Springs, NY (US)

(72) Inventor: Jon Lawrence, Greenfield Center, NY (US)

(73) Assignee: Freedom Manufacturing LLC, Saratoga Springs, NY (US)

( * ) Notice: Subject to any disclaimer, the term of this patent is extended or adjusted under 35 U.S.C. 154(b) by 38 days.

(21) Appl. No.: 14/876,441

(22) Filed: Oct. 6, 2015

(65) Prior Publication Data

US 2017/0096296 A1 Apr. 6, 2017

(51) Int. Cl.
*B65D 35/56* (2006.01)
*B65D 90/04* (2006.01)
*B65D 88/54* (2006.01)

(52) U.S. Cl.
CPC ..... *B65D 90/047* (2013.01); *B65D 88/54* (2013.01)

(58) Field of Classification Search
CPC .. B65D 90/046; B65D 90/047; B65D 90/048; B65D 88/54
USPC ..... 222/94, 92, 106, 206–209, 105; 383/17, 383/20, 41, 60, 105, 114; 220/495.01, 220/494.02–495.11
See application file for complete search history.

(56) References Cited

U.S. PATENT DOCUMENTS 4,635,814 A 1/1987 Jones
4,947,988 A 8/1990 Schutz
5,385,268 A 1/1995 LaFleur et al.
5,678,688 A 10/1997 Schutz
5,794,670 A 8/1998 LaFleur
5,836,363 A 11/1998 LaFleur
5,851,072 A 12/1998 LaFleur
5,897,012 A 4/1999 Sortwell
6,244,459 B1 6/2001 Bouc et al.
6,305,845 B1 10/2001 Navin
6,505,657 B1 1/2003 Lawrence
7,140,490 B2 11/2006 Przytulla
7,556,171 B2 * 7/2009 Ishimaru ..... F17C 1/16 220/581
7,648,042 B2 * 1/2010 Lee ..... F17C 13/06 220/582
8,087,537 B2 * 1/2012 Otsubo ..... F17C 1/14 220/581
8,505,762 B2 * 8/2013 Holbach ..... F17C 13/06 220/586
9,316,357 B2 * 4/2016 Heo ..... F17C 13/002

* cited by examiner

*Primary Examiner* — Lien Ngo

(74) *Attorney, Agent, or Firm* — Matthew J. Kinnier; Hoffman Warnick LLC

(57) ABSTRACT

A liner discharge structure, and associated liner and container system are disclosed. A liner discharge structure according to the present disclosure can include: a neck collar fabricated from a liner material, wherein the neck collar encapsulates a first O-ring in the liner material; a neck fabricated from the liner material and including a first end coupled to the neck collar and in fluid communication with container liner, wherein the neck provides a passageway extending from the first end to a second end; and a discharge collar fabricated from the liner material and coupled to the second end of the neck, wherein the discharge collar encapsulates a second O-ring therein.

20 Claims, 3 Drawing Sheets

LINER DISCHARGE STRUCTURE FOR ATTACHMENT TO CONTAINER LINER

TECHNICAL FIELD

The subject matter of the present disclosure relates to container liners, and more particularly to a container liner including and/or attached to a liner discharged structure for improved liner performance.

BACKGROUND

Bulk containers, including tanks and totes, are used in many applications to hold and ship fluids. Illustrative fluids may for example include industrial liquids, such as chemicals and paints, as well as consumer products such as lotions and other beauty products. Regardless, in many applications, a key challenge is the need to avoid or eliminate contamination from these products within the container. For instance, introducing a foreign substance into a high performance chemical can negatively affect the contents of the container and/or the material composition of the container. As a result of these concerns, governmental agencies such as the Food and Drug Administration (FDA) have set stringent standards for liquid products stored in containers that are to be consumed or applied to people.

In some applications, a disposable single-use or multi-use liner can be installed within a container to reduce or eliminate contamination. For example, U.S. Pat. No. 6,505,657, entitled "Container Liners and Methods of Lining Containers," issued on Jan. 14, 2003, the contents of which is hereby incorporated by reference, teaches a liner system for use with tanks, such as an intermediate bulk container (IBC). In such an application, the liner can be shaped to conform to the inner surface of the container, so as to not interfere with any product contained therein.

While the use of liners greatly enhances the performance, lifespan and usability of a container, liners present various challenges. One such challenge is the need to ensure that the liner is easy to install and does not interfere with the operation of the container. For example, some containers may include a discharge opening at the bottom for discharging fluids through a valve. Under certain circumstances, the liner could slip within the tank and interfere with the opening. Another challenge is the need to ensure that the liner material is compatible with the particular fluids being held therein. These attributes can limit the use of liners for particular types of tanks, e.g., bottom-discharge tanks which include at least partially vertical discharge spouts.

SUMMARY

A first aspect of the present disclosure provides a liner discharge structure adapted for use with a container liner, the liner discharge structure including: a liner discharge structure adapted for attachment to a container liner, the liner discharge structure comprising: a neck collar fabricated from a liner material, wherein the neck collar encapsulates a first O-ring in the liner material; a neck fabricated from the liner material and including a first end coupled to the neck collar and in fluid communication with the container liner, wherein the neck provides a passageway extending from the first end to a second end; and a discharge collar fabricated from the liner material and coupled to the second end of the neck, wherein the discharge collar encapsulates a second O-ring therein.

A second aspect of the present disclosure provides a liner for a container, including: a liner body shaped and adapted to conform to an inner wall of the container, wherein the liner body is fabricated from a liner material; and a liner discharge structure attached to a liner opening in the liner body, the liner discharge structure including: a neck collar fabricated from a liner material, wherein the neck collar encapsulates a first O-ring in the liner material, a neck fabricated from the liner material and including a first end coupled to the neck collar and in fluid communication with the liner opening, wherein the neck provides a passageway extending from the first end to a second end, and a discharge collar fabricated from the liner material and coupled to the second end of the neck, wherein the discharge collar encapsulates a second O-ring therein.

A third aspect of the present disclosure provides a container system, including: a container having a substantially axially-downward discharge spout in fluid communication with a narrowing region thereof; and a liner positioned within the container and including: a liner body shaped and adapted to conform to an inner wall of the container, wherein the liner body is fabricated from a liner material, and a liner discharge structure attached to a liner opening in the liner body, the liner discharge structure including: a neck collar fabricated from a liner material, wherein the neck collar encapsulates a first O-ring in the liner material; a neck fabricated from the liner material and including a first end coupled to the neck collar and in fluid communication with the liner opening, wherein the neck provides a passageway extending from the first end to a second end; and a discharge collar fabricated from the liner material and coupled to the second end of the neck, wherein the discharge collar encapsulates a second O-ring therein.

BRIEF DESCRIPTION OF THE DRAWINGS

These and other features of this invention will be more readily understood from the following detailed description of the various aspects of the invention taken in conjunction with the accompanying drawings in which.

Figure 1:
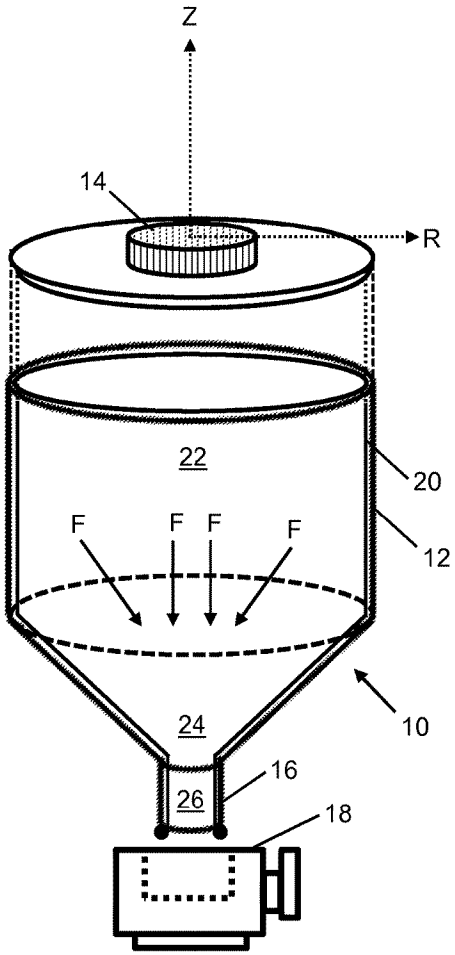
FIG. 1 shows a container having a liner with a liner discharge structure according to embodiments of the present disclosure.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Embodiments of the present disclosure provide a liner discharge structure adapted for attachment to a container liner, as well as a liner for a container and a container system which include embodiments of the liner discharge structure discussed herein. A liner discharge structure according to the present disclosure can include a neck collar fabricated from a liner material, e.g., the same material used to fabricate a remainder of the liner. The neck collar can encapsulate an O-ring, and thereby isolate the O-ring from a structure and material composition a container in addition to fluid contents within the container liner. The liner discharge structure can also include a neck section composed of, e.g., the same material as the neck collar and the remainder of the container liner. The liner material can extend from a first end, coupled to the neck collar, to an axially displaced second end of the neck. The second end of the neck can be coupled to a discharge collar fabricated from, e.g., the same material as the neck, neck collar, and container liner. The discharge collar can encapsulate a second O-ring therein. The discharge collar can thereby physically separate the second O-ring and materials within the container liner from the physical structure and material composition of the container itself. During operation, liner discharge structures according to the present disclosure can physically engage a discharge spout of the container (oriented, e.g., axially downward) while preventing contamination of the container structure from materials within the container liner.

Referring to FIG. 1, an illustrative container 10 generally includes an inner wall 12, a filling port 14 and a discharge spout 16. Container 10 can be of any size, and more specifically can be provided with any conceivable height and/or length dimension as indicated with partial phantom lines. For the purposes of this disclosure, the term container may refer to any tank, tote, vessel, etc., that is capable of storing fluids. Further, such containers may be fabricated from any material, including PVC, metal, composites, etc. Discharge spout 16 can receive a valve 18, e.g., with threading, for controlling an amount of fluid discharge from container 10. Container 10 can be positioned within an external structure (not shown) such as a frame, fixture, etc., for maintaining a desired position and/or orientation of container 10 and components thereof during use.

As shown, container 10 can include a liner 20 therein having a liner body 22, a narrowing region 24, and a liner discharge structure 26 (shown in dashed lines), such that a portion of liner 20 is seated at least within discharge spout 16. Container 10 and liner 20 can extend substantially along an axial axis "Z," with a radial axis "R" extending outwardly therefrom. Liner body 22 can be shaped and adapted to conform to inner wall 12 during operation, e.g., by being manufactured with substantially the same size, shape, etc., as container 10 where liner 20 is used. The interposition of narrowing region 24 between liner body 22 and liner discharge structure 26 can cause a cross-sectional area of liner 20 at liner discharge structure 26 to be less than a cross-sectional area of liner 20 within liner body 22 by a predetermined factor, e.g., by an approximately 1:2, 1:4, 1:10 area ratio or by any other desired ratio between areas. Narrowing region 24 can thus have a distinct shape from liner discharge structure 26 and liner 20, and in an example embodiment can make up at least a partially frusto-conical region of liner 20. In any event, the size of liner 20 can vary during manufacture based on the size of container 10 where liner 20 is used, as indicated with the corresponding phantom lines. Embodiments of the present disclosure can include features of liner discharge structure 26 at discharge spout 16 to aid, e.g., the discharge flow of chemicals from container 10 while reducing the amount of slipping or other dislocations of liner 20 from container 10.

Although liner 20 is shown as being separated from inner wall 12, discharge spout 16, etc., in FIG. 1 for ease of description, it is understood that liner 20 and components thereof can structurally conform to the dimensions of container 10 using known techniques. For example, where liner 20 is composed of a pliable material such as a polymer compound, the various components of liner 20 can take up substantially no space, e.g., by having a thickness of less than approximately 1.0 centimeters (cm) and thereby cause no interference with the operation of container 10.

As will be described in further detail herein, liner discharge structures 26 according to embodiments of the present disclosure can reduce or prevent movements of liner 20 within container 10, e.g., by preventing portions of liner body 22 from sliding down and obstructing discharge spout 16. Although liner body 22 is adapted to conform to the inner wall 12, gravity, changes in temperature, movement of contained fluids along the direction of arrows F, operating conditions, vibrations from transportation of the container, etc., can sometimes cause liner body 22 to gradually slide downwards in conventional liner assemblies. The physical engagement and interaction between discharge spout 16 and liner discharge structure 26 can also prevent cross-sectional narrowing and/or partial collapse of liner 20 within discharge spout 16.

Each subcomponent or sub-section of liner 20, including liner body 22, narrowing section 24, and/or liner discharge structure 26 can be fabricated from the same material or group of materials, such that the complete material composition of liner 20 is non-contaminating relative to materials therein and/or the structure of container 10. One or more of the materials used to form liner 20 can be selected to provide physical engagement, attachment, attraction, etc., between container 10 and liner 20 pursuant to any currently-known or later-developed technique for physically engaging two materials together. In an example embodiment, liner 20 can be composed of a multilayer substrate having properties compatible with the fluid within container 10. Accordingly, selection of the liner material may change based on the intended application. Generally, the same liner material can be used for liner body 22, narrowing section 24, and liner discharge structure 26 to ensure a homogeneous containment environment.

Figure 2:
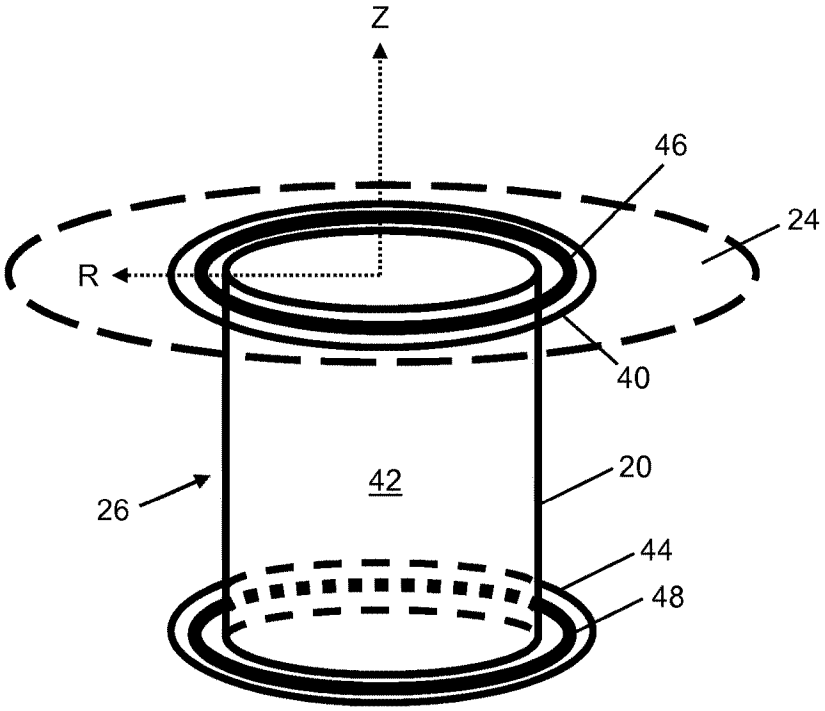
FIG. 2 provides a perspective view of a liner discharge structure adapted for a container according to embodiments of the present disclosure.

Referring to FIG. 2, a detailed view of liner discharge structure 26 for integration into liner 20 of container 10 is provided. As discussed herein, liner discharge structure 26 can be fabricated separately from liner body 22 (FIG. 1), thereafter being attached to an opening in liner body 22 using any technique that does not introduce any foreign material, e.g., heat sealing, vibration welding, ultrasonic welding, etc.

Liner discharge structure 26 can generally include a neck collar 40, a neck 42, and a discharge collar 44. Neck collar 40 can fully encapsulate a first O-ring 46, while discharge collar 44 can fully encapsulate a second O-ring 48. Each collar 40, 44 can be formed completely about respective O-rings 46, 48 therein such that collars 40, 44 physically isolate each O-ring 46, 48 from the contents of container 10 and liner 20. The entirety of liner discharge structure 26, with the exception of encapsulated first and second O-rings 46, 48, can be fabricated from the same material as the remainder of liner 20 to which it will be attached. First and/or second O-rings 46, 48 can be composed of a solid material adapted for placement on a rigid structure, e.g., one or more plastics and/or malleable metals. In addition, first and/or second O-rings 46, 48 by contrast can be less flexible than the material composition of liner 20 yet may retain sufficient flexibility to be temporarily bent, deformed, rotated, shrunk, or otherwise physically adapted to pass through discharge spout 16 during installation of liner 20. Thus, the entire surface area of liner discharge structure 26 can be chemically homogeneous with liner 20 so as to ensure compatibility with the fluids contained therein. The use of chemically homogeneous materials throughout liner discharge structure 26 also allows for simplified manufacturing, i.e., reducing the number of technical challenges associated with welding or sealing various materials together.

Neck 42 can be fabricated, e.g., in a substantially tubular arrangement from one or more sections of liner material that is welded along one or more seams (not shown). Neck 42 can also be welded to narrowing region 24 of liner body 22 (FIG. 1) along one or more seams (not shown) to provide a passageway between an opening in narrowing region 24 and neck collar 40. Neck and discharge collars 40, 44 may be fabricated using excess neck liner material along the edge of the neck and/or additional liner material. As discussed herein, each O-ring 46, 48 can be fully encapsulated in the material composition of neck and discharge collars 40, 44, respectively, to eliminate any possibility of contamination.

Neck 42, as a result of the compositional and manufacturing attributes described herein, can have a substantially cylindrical shape to thereby provide a fluid passageway between opposing ends of liner discharge structure 26, and to provide other operational features. Each O-ring 46, 48 of liner discharge structure 26 can thus be oriented substantially in parallel with each other at first and second opposing axial ends (e.g., along axis Z), coincident with neck collar 40 and discharge collar 44. Neck 42 can thus be axially coupled to liner 20 at the interior of narrowing section 24, with discharge collar 44 providing an outlet for fluid communication between the interior of liner 20 (FIG. 1) and the environment through liner discharge structure 26.

Figure 3:
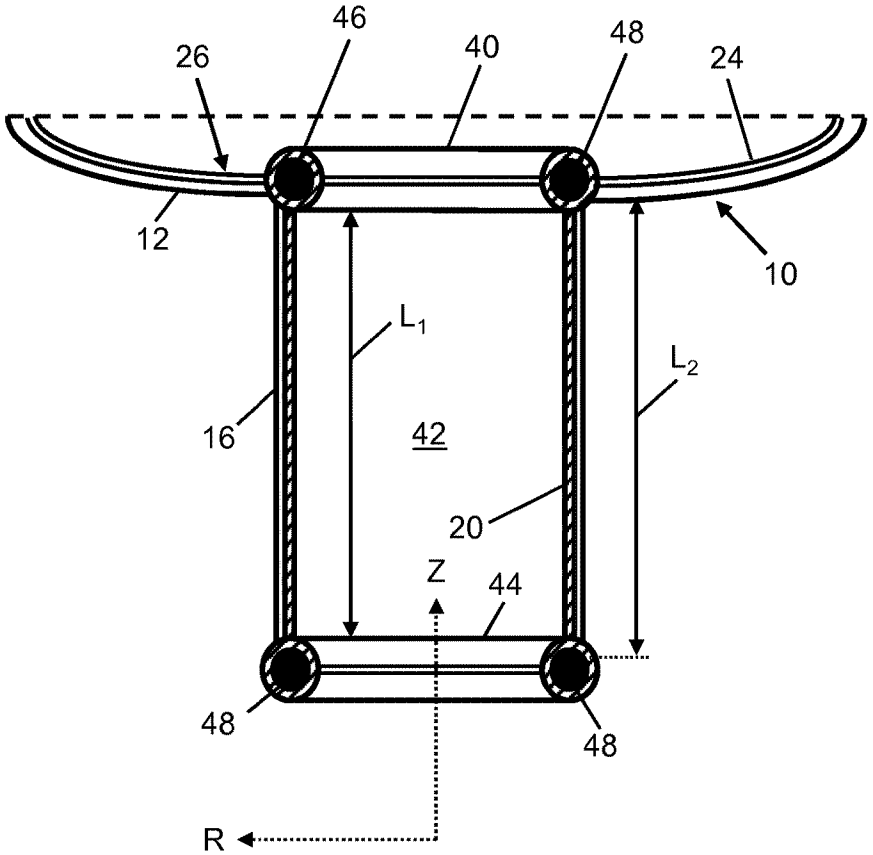
FIG. 3 shows a cut-away cross-sectional view of a liner discharge structure and container according to embodiments of the present disclosure.

Turning to FIG. 3, the position of neck 42 as a cylindrical passage between O-rings 46, 48 is shown to aid in the positioning and stability of liner discharge structure 26 during use. In particular, a length $L_1$ of neck 42 between collars 40, 44 can be less than the length $L_2$ of discharge spout 16, e.g., by a difference of approximately 5.0 cm to approximately 20 cm. In addition, as cross-sectional area of each O-ring 46, 48 can be greater than a cross-sectional area of discharge spout 16. The differences in length and cross-sectional area between neck 42 and discharge spout 16 can allow each O-ring 46, 48 to be seated on portions of container 10. For instance, first O-ring 46 can rest at least partially on inner wall 12 proximal to narrowing section 24 of liner 20. Second O-ring 48 can rest against container 10 at the exterior of discharge spout 16. The position of first and second O-rings 46, 48, can thereby cause liner discharge structure 26 to be taut when liner 20 is installed within container 10, substantially reducing the risk of collapse when materials exit the interior of liner 20 through liner discharge structure 26.

As noted herein, the particular size and configuration of the liner discharge structure 26 is dependent upon the features of each container 10 where it will be used. For example, in some instances, discharge spout 16 may be oriented partially or completely axially downward (i.e., along the same direction as gravitational force) from the bottom of a cone-shaped container, creating a potential for liner 20 and/or components thereof to slide downward from any direction. In such a case, one or both O-rings 46, 48 can provide an equal amount of rigidity about the circumference of discharge spout 16. Moreover, although specific shapes are discussed herein, liner discharge structure 26 and/or other portions of liner 20 could be fashioned in a variety of forms, e.g., conical, rounded, etc., to conform with inner wall 12 proximate discharge spout 16.

Embodiments of the present disclosure can provide several technical and commercial advantages, some of which are discussed by example herein. For example, some types of containers such as "intermediate bulk containers" (IBCs) may be adapted for use with one or more contaminant-sensitive materials, e.g., cosmetic products, food products, etc. In this case, the orientation of a particular container and/or discharge spouts therefrom may be specific to the substances being stored and/or transported therein. For example, one or more discharge spouts may be required to have a downward orientation, e.g., along the direction of gravitational forces. To reduce or eliminate contamination while retaining the structure and orientation of a liner in this type of container, embodiments of the present disclosure can provide additional structural rigidity proximal to the discharge spout of a container. In addition, embodiments of the present disclosure can house and physically isolate materials with different chemical compositions from the contents of a container, e.g., by the manner discussed herein relative to the positioning of O-rings within respective collars of a discharge structure. Embodiments of the present disclosure can thereby improve the quality and cost-effectiveness of liners in addition to improving the lifespan of a container, e.g., by allowing multiple liners to be used successively therein.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A liner discharge structure adapted for attachment to a container liner, the liner discharge structure comprising:

a neck collar fabricated from a liner material, wherein the neck collar encapsulates a first O-ring in the liner material;

a neck fabricated from the liner material and including a first end coupled to the neck collar and in fluid communication with the container liner, wherein the neck provides a passageway extending from the first end to a second end; and a discharge collar fabricated from the liner material and coupled to the second end of the neck, wherein the discharge collar encapsulates a second O-ring therein.

2. The liner discharge structure of claim 1, further comprising a liner body coupled to the neck collar, wherein a cross-sectional area of the liner body at a first position proximal to the neck collar is less than a cross-sectional area of the liner body at a second position distal to the neck collar.

3. The liner discharge structure of claim 1, wherein a shape of the neck is substantially cylindrical.

4. The liner discharge structure of claim 1, wherein the neck collar rests on a first axial end of an axial discharge spout, and wherein the discharge collar is positioned directly beneath a second axial end of the axial discharge spout.

5. The liner discharge structure of claim 4, wherein a length of the neck is less than a length of the axial discharge spout.

6. A liner for a container, comprising:

a liner body shaped and adapted to conform to an inner wall of the container and configured to contain a product, wherein the liner body is fabricated from a liner material; and a liner discharge structure attached to a liner opening in the liner body, the liner discharge structure including:

a neck collar fabricated from a liner material, wherein the neck collar encapsulates a first O-ring in the liner material and fluidly isolates the first O-ring from the product within the liner body;

a neck fabricated from the liner material and including a first end coupled to the neck collar and in fluid communication with the liner opening, wherein the neck provides a passageway extending from the first end to a second end; and a discharge collar fabricated from the liner material and coupled to the second end of the neck, wherein the discharge collar encapsulates a second O-ring in the liner material and fluidly isolates the second O-ring from the product within the liner body.

7. The liner of claim 6, wherein a shape of the liner body is at least partially frusto-conical.

8. The liner of claim 6, wherein a shape of the discharge structure is substantially cylindrical.

9. The liner of claim 6, wherein the neck collar rests on a first axial end of an axial discharge spout of the container, and wherein the discharge collar is positioned directly beneath a second axial end of the axial discharge spout of the container.

10. The liner of claim 9, wherein a length of the neck of the discharge structure is less than a length of the axial discharge spout of the container.

11. The liner of claim 6, wherein the neck collar physically isolates the first O-ring from the container, and wherein the discharge collar physically isolates the second O-ring from the container.

12. A container system, comprising:

a container having an axial discharge spout in fluid communication with a narrowing region thereof; and a liner positioned within the container configured to contain a product and including:

a liner body shaped and adapted to conform to an inner wall of the container, wherein the liner body is fabricated from a liner material; and a liner discharge structure attached to a liner opening in the liner body, the liner discharge structure including:

a neck collar fabricated from a liner material, wherein the neck collar encapsulates a first O-ring in the liner material and fluidly isolates the first O-ring from the product within the liner body;

a neck fabricated from the liner material and including a first end coupled to the neck collar and in fluid communication with the liner opening, wherein the neck provides a passageway extending from the first end to a second end; and a discharge collar fabricated from the liner material and coupled to the second end of the neck, wherein the discharge collar encapsulates a second O-ring in the liner material and fluidly isolates the second O-ring from the product within the liner body.

13. The container system of claim 12, wherein a shape of the neck is substantially cylindrical.

14. The container system of claim 12, wherein the neck collar rests on a first axial end of the axial discharge spout of the container, and wherein the discharge collar is positioned directly beneath a second axial end of the axial discharge spout of the container.

15. The container system of claim 14, wherein a length of the neck is less than a length of the axial discharge spout.

16. The container system of claim 12, wherein the neck collar physically isolates the first O-ring from the container, and wherein the discharge collar physically isolates the second O-ring from the container.

17. The container system of claim 12, wherein a shape of the narrowing region of the container is substantially frusto-conical.

18. The liner discharge structure of claim 1, wherein the container liner is configured to contain a product, and wherein the first O-ring is fluidly isolated from the product within the container liner, and wherein the second O-ring is fluidly isolated from the product within the container liner.

19. The liner of claim 6, wherein the container has a discharge spout, and wherein the liner discharge structure is shaped and adapted to conform to an inner wall of the discharge spout.

20. The container system of claim 12, wherein the liner discharge structure is shaped and adapted to conform to an inner wall of the axial discharge spout.

* * * * *